US005957715A

United States Patent [19]

Fukuda

[11] Patent Number: 5,957,715

[45] Date of Patent: Sep. 28, 1999

[54] WATERPROOF CONNECTOR

[75] Inventor: Masaru Fukuda, Shizuoka-ken, Japan

[73] Assignee: Yazaki Corporation, Tokyo, Japan

[21] Appl. No.: 08/986,724

[22] Filed: Dec. 8, 1997

[30] Foreign Application Priority Data

Dec. 19, 1996 [JP] Japan ..... 8-339769

[51] Int. Cl.[6] ..... H01R 13/52

[52] U.S. Cl. ..... 439/271

[58] Field of Search ..... 439/271, 374, 439/923

[56] References Cited

U.S. PATENT DOCUMENTS 5,730,625 3/1998 Sikora ..... 439/271
5,820,395 10/1998 Hashizawa ..... 439/271

FOREIGN PATENT DOCUMENTS 57-72574 5/1982 Japan .
5-48247 6/1993 Japan .
8-1576 1/1996 Japan .

*Primary Examiner*—Khiem Nguyen
*Attorney, Agent, or Firm*—Finnegan, Henderson, Farabow, Garrett & Dunner, L.L.P.

[57] ABSTRACT

A waterproof connector comprises a female connector 2 having a female-side hood 2*c* surrounding an outer periphery of a male terminal 2*a* to form a seal receiving space 2*b;* a male connector 1 having a male-side hood 1*c* surrounding an outer periphery of a male housing 1*a* including a female terminal so as to form a hood receiving space 1*b;* and an annular seal member 3 attached to an outer peripheral surface of the male housing 1*a* which is elastically deformed when the connectors 1 and 2 are connected to each other, wherein an open end 2*d* of the female-side hood 2*c* is inclined to an insertion direction of the connectors 1 and 2.

3 Claims, 3 Drawing Sheets

WATERPROOF CONNECTOR

BACKGROUND OF THE INVENTION

1. Field of the Invention

The present invention relates to a waterproof connector which can perform waterproofing by elastically deforming a seal member when connecting a male connector and a female connector to each other.

2. Description of the Related Art

In the related art, there is a waterproof connector which has been disclosed in Japanese Utility-Model Publication No. 8-1576. In the waterproof connector, when connecting a male connector and a female connector to each other, waterproofing between the male connector and the female connector is performed in the following manner. Specifically, a male terminal is inserted into a female terminal of a male housing, and then, a seal member having a threaded seal portion which is formed on the outer peripheral surface of the male housing, is closely abutted against an inner peripheral surface of a female-side hood while being elastically deformed by the inner peripheral surface thereof, thus waterproofing being performed.

In the aforesaid waterproof connector, however, an open end of a female-side hood and the seal portion of the seal member are both formed so as to be perpendicular to an insertion direction X. For this reason, in a process of inserting the female-side hood into a hood receiving space of the male connector, the open end of the female-side hood is in a state of simultaneously going beyond the seal portion of the seal member over the entire circumstance thereof. Thus, the following tendency appears therein. Specifically, an insertion force has a variation such that it rapidly increases, and thereafter, rapidly lowers, and then, becomes high. This causes a problem that an insertion work becomes complicated or troublesome due to an increase of the insertion force. Conversely, if the outer periphery of the seal portion is made small in order to achieve a reduction of the insertion force, a sealing performance is lowered, causing a problem of lowering reliability of the sealing performance.

SUMMARY OF THE INVENTION

The present invention has been achieved with such point in mind.

It therefore is an object of the present invention to provide a waterproof connector in which an insertion force is gradually increased can improve insertion workability and reliability of waterproof.

It is another object of the present invention to provide a waterproof connector in which the insertion force is wholly reduced can improve insertion workability and reliability of waterproof.

To achieve the object, according to a first aspect of the present invention, there is provided a waterproof connector comprising: a female connector having a terminal and a hood surrounding the terminal to form a seal receiving space; a male connector having a male housing formed with a terminal receiving portion receiving the terminal of the female connector; and a seal member attached to an outer peripheral surface of the male housing, the seal member being elastically deformed that an outer periphery of the seal member being closely abutted against an inner peripheral surface of the hood when the female connector and the male connector are connected to each other in an insertion direction, wherein the hood has an open end which is formed inclined to the insertion direction of the female and male connectors.

With the construction of the first aspect, since the open end of the female-side hood is formed inclined to the insertion direction of the connectors, when the open end goes beyond the seal member in a process of connecting the male connector and the female connector to each other, the open end does not go beyond the seal member at the same time over the entire circumference of the seal member. Thus, an insertion force is gradually increase while being reduced. Therefore, insertion workability and reliability in seal performance can be improved together.

According to a second aspect of the present invention, as it depends from the first aspect, an inner peripheral surface of the open end of the hood is formed with an inclined plane; and the inclined plane is enlarged while progressing to a tip portion of the hood.

With the construction of the second aspect, the inclined plane formed in the female-side hood functions as a guide for insertion, so that the seal member can be suitably guided along the inner peripheral surface by means of the inclined plane, in addition to the operation of the invention described in the first aspect.

According to a third aspect of the present invention, as it depends from the second aspect, the width of the seal receiving space at the tip portion of the hood is larger than the width of the seal member.

With the construction of the third aspect, since the seal member is inserted along the inclined plane of the hood which is larger than an outer width of the seal member, this serves to gently rise the insertion force, in addition to the operation of the invention described in the second aspect.

According to a fourth aspect of the present invention, as it depends from the first aspect, the seal member is provided with a plurality of threaded seal portions formed at the outer periphery of the seal member along the insertion direction.

With the construction of the forth aspect, the inclined open end is abutted against the seal member which is formed with the plurality of threaded seal portions, in addition to the operation described in the invention according to the first to the third aspects. Therefore, sealing can be securely performed, and reliability in seal performance can be also improved.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
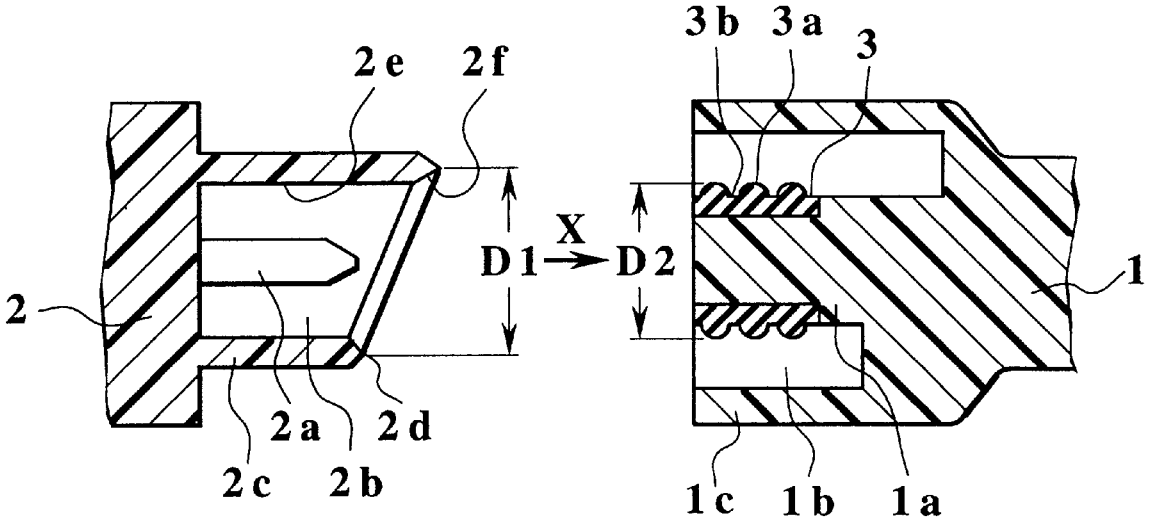
FIG. 1 is a cross-sectional view showing a waterproof connector according to one embodiment of the present invention.

There will be detailed below the preferred embodiments of the present invention with reference to the accompanying drawings. Like members are designated by like reference characters.

FIG. 1 to FIG. 4 show one embodiment of the present invention, and in these figures, a reference numeral 1 designates a male connector. The male connector 1 has a male housing 1*a* having a female terminal (not shown) which is received in each insertion opening 1*d* as a terminal receiving portion shown in FIG. 4, and a male-side hood 1*c* which surrounds an outer periphery of the male housing 1*a* so that a hood receiving space 1*b* is formed, for example.

A reference numeral 2 designates a female connector. The female connector 2 has a male terminal 2*a* as a terminal, and a female-side hood 2*c* as a hood which surrounds an outer periphery of the male terminal so that a seal receiving space is formed.

According to this embodiment, the female-side hood 2*c* has an open end 2*d* which is formed inclined to an insertion direction X. An inner peripheral surface 2*e* on the open end 2*d* side is formed with an annular inclined plane 2*f* which enlarges the inner peripheral surface 2*e* with respect to the open end 2*d*. In other wards, the inclined plane 2*f* is enlarged while progressing toward a tip end of the female-side hood 2*c*. An opening D1 of the open end 2*d* as a width of the seal receiving space is set to a dimension larger than a outer diameter D2 of a threaded seal portions 3*a* formed on the seal member 3 attached to the male connector 1 (D1>D2). In this embodiment, the opening D1 and the profile of the seal portion 3*a* is a rectangular shape, and the above relation of D1>D2 means that a vertical length of the former (D1) is longer than that of the latter (D2).

The aforesaid seal member 3 is a member like a cylinder which is attached to the outer peripheral surface of the male housing 1*a* in the hood receiving space 1*b* of the male connector 1. An outer peripheral surface of the seal member 3 is provided with a plurality of threaded seal portions 3*a* and annular channel portions 3*b* which are alternately formed so as to be perpendicular to the insertion direction X.

Figure 3:
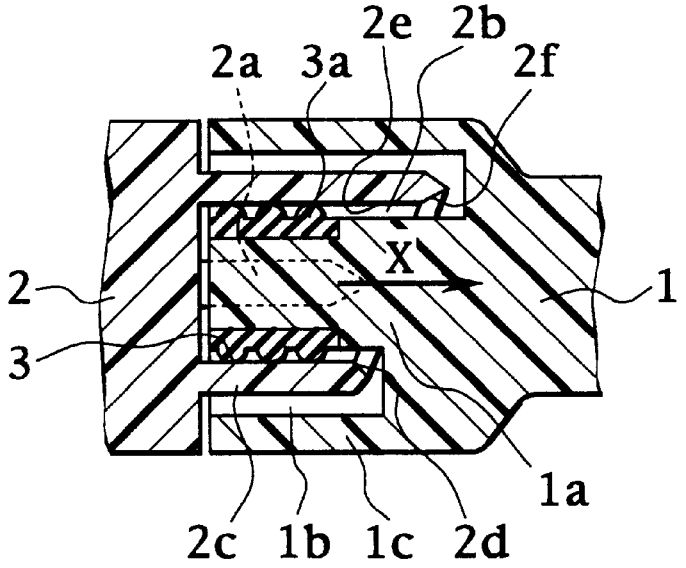
FIG. 3 is a cross-sectional view showing a inserting completed state of the waterproof connector in the above same embodiment.
Figure 4:
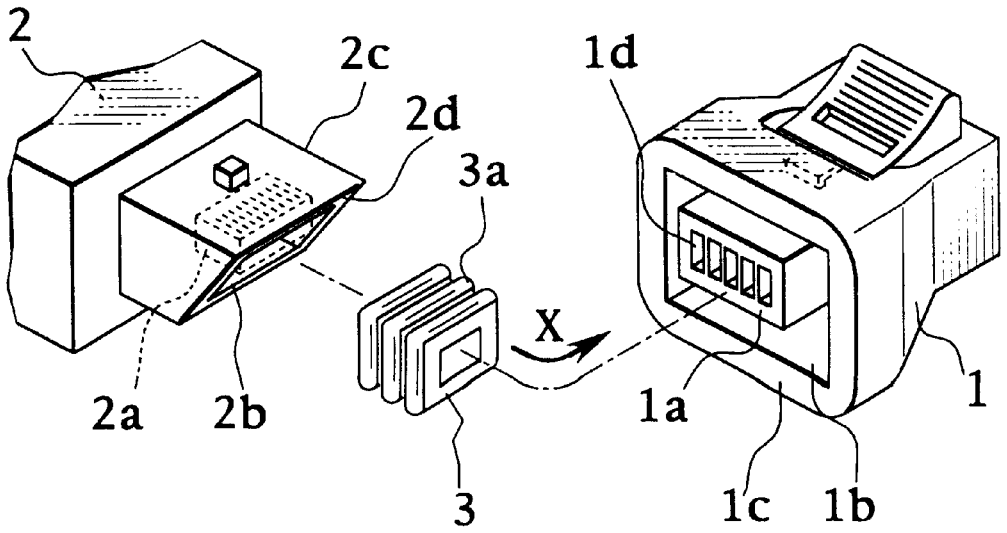
FIG. 4 is a exploded perspective view of the waterproof connector in the above embodiment.

With the above construction as described in this embodiment, when the male connector 1 and the female connector 2 are connected to each other as shown in FIG. 3 in a state that the seal member 3 shown in FIG. 1 is attached to the male connector 1, the seal member 3 is inserted into the seal receiving space 2*b* of the female connector 2 while the female-side hood 2*c* being inserted into the hood receiving space 1*b* of the male connector 1. And then, the seal portion 3*a* formed on the seal member 3 is elastically deformed so as to be closely abutted against the inner peripheral surface 2*e* of the female-side hood 2*c*, and thus, waterproofing being performed.

Figure 2:
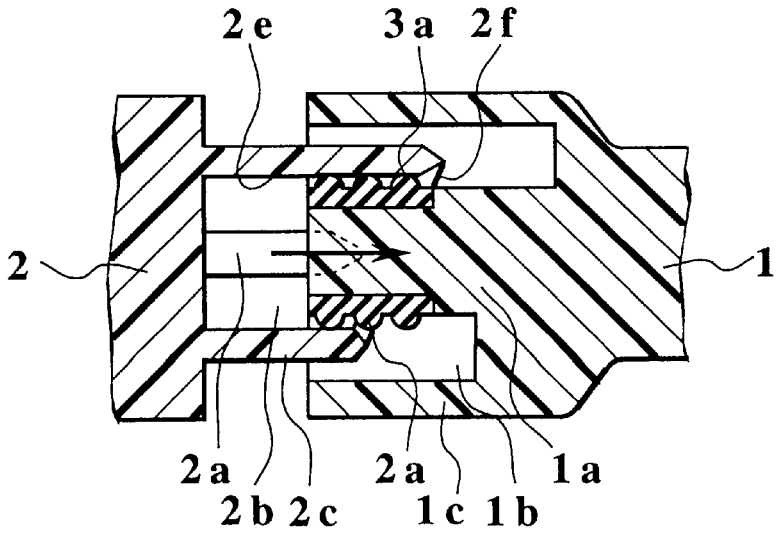
FIG. 2 is a cross-sectional view showing an inserting halfway state of the waterproof connector in the above same embodiment.

In a process in which the female-side hood 2*c* is inserted into the hood receiving space 1*b*, as seen from FIG. 2, in the case where the open end 2*d* of the female-side hood 2*c*, which is formed inclined to the insertion direction X, goes beyond one threaded seal portion 3*a* formed on the seal member 3, the open end 2*d* does not go beyond over the entire periphery at the same time.

Figure 5:
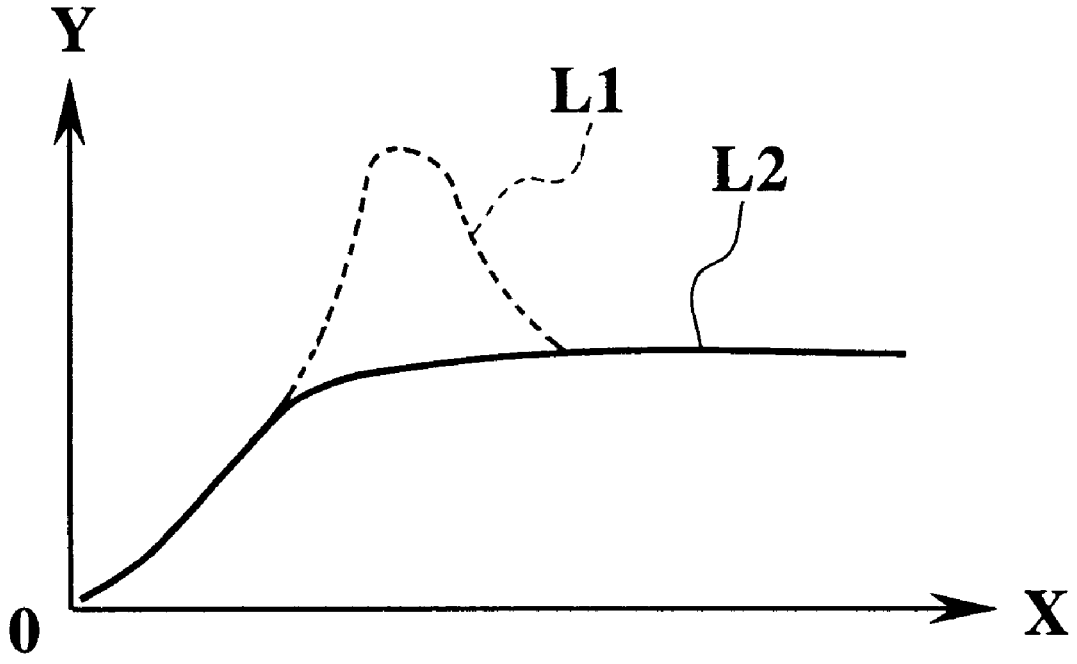
FIG. 5 is a characteristic chart showing a relationship between an insertion distance and an insertion force in the above embodiment.

Therefore, when connecting the male connector 1 and the female connector 2 to each other, there is no generation of an insertion force as a conventional rapid changed portion shown by a broken line L1 in FIG. 5. The insertion force can be gradually increased while being reduced as shown by a solid line L2 in FIG. 5. In FIG. 5, the abscissa X takes an insertion distance of the female connector 2 with respect to the male connector 1 in the insertion direction X shown in FIG. 1; in other words, it shows a depth of fitting of both male and female connectors 1 and 2. On the other hand, the ordinate Y takes the aforesaid insertion force.

Moreover, the annular inclined plane 2*f* formed on the female-side hood 2*c* serves to suitably and smoothly guide the seal member 3 so that the seal member is closely abutted against the inner peripheral surface 2*e*. In addition, the relation of D1>D2 serves to further suitably guide the seal member.

The construction of the connectors according to the present invention is applicable for optical connectors other than electrical connectors.

While preferred embodiments of the present invention have been described using specific terms, such description is for illustrative purposes, and it is to be understood that changes and variations may be made without departing from the spirit or scope of the following claims.

What is claimed is:

1. A waterproof connector, comprising:

a female connector having a terminal and a hood surrounding the terminal to form a seal receiving space;

a male connector having a male housing formed with a terminal receiving portion receiving the terminal of the female connector; and a seal member attached to an outer peripheral surface of the male housing, the seal member being elastically deformed that an outer periphery of the seal member being closely abutted against an inner peripheral surface of the hood when the female connector and the male connector are connected to each other in an insertion direction, wherein the hood has an open end which is formed inclined to the insertion direction of the female and male connectors;

wherein an inner peripheral surface of the open end of the hood is formed with an inclined plane; and the inclined plane is enlarged while progressing toward a tip end of the hood.

2. The waterproof connector according to claim 1, wherein the width of the seal receiving space at the tip end of the hood is larger than the width of the seal member.

3. The waterproof connector according to claim 1, wherein the seal member is provided with a plurality of threaded seal portions formed at the outer periphery of the seal member along the insertion direction.

* * * * *